United States Patent [19]

Taskinen

[11] Patent Number: 4,810,370

[45] Date of Patent: Mar. 7, 1989

[54] APPARATUS FOR SEPARATING MATERIALS

[75] Inventor: Pekka M. Taskinen, Espoo, Finland

[73] Assignee: Outokumpu Oy, Helsinki, Finland

[21] Appl. No.: 239,022

[22] Filed: Aug. 29, 1988

Related U.S. Application Data

[63] Continuation of Ser. No. 16,263, Feb. 19, 1987, abandoned.

[30] Foreign Application Priority Data

Mar. 3, 1986 [FI] Finland ..... 860896

[51] Int. Cl.[4] ..... B03B 5/62

[52] U.S. Cl. ..... 209/155; 209/158; 209/460

[58] Field of Search ..... 209/155, 158, 160, 208, 209/210, 454, 459, 460, 209

[56] References Cited

U.S. PATENT DOCUMENTS

| | | | |
|---|---|---|---|
| 1,959,212 | 5/1934 | Miller | 209/158 |
| 2,688,402 | 9/1954 | Butterworth | 209/208 |
| 2,708,517 | 5/1955 | Evans | 209/158 |
| 2,854,136 | 9/1958 | Gillie et al. | 209/158 |
| 2,931,499 | 4/1960 | Wahlroos et al. | 209/158 |
| 3,190,729 | 6/1965 | Emmett et al. | 209/158 |
| 3,282,422 | 11/1966 | Reynolds et al. | 209/454 |
| 4,264,439 | 4/1981 | Lefevre et al. | 209/454 |

FOREIGN PATENT DOCUMENTS 3210972 10/1983 Fed. Rep. of Germany .

*Primary Examiner*—Johnny D. Cherry
*Assistant Examiner*—Donald T. Hajec
*Attorney, Agent, or Firm*—Dellett, Smith-Hill and Bedell

[57] ABSTRACT

The invention relates to an apparatus for separating materials by making use of the difference in the specific gravities, when the material under separation is made to flow in countercurrent with respect to the flowing medium. The separating apparatus of the invention is advantageously composed of at least two flow pipes (2) with essentially equal diameters, and each of these is provided with a connected side flow pipe (6) by aid of which the material under separation can be divided into at least three different fractions.

13 Claims, 1 Drawing Sheet

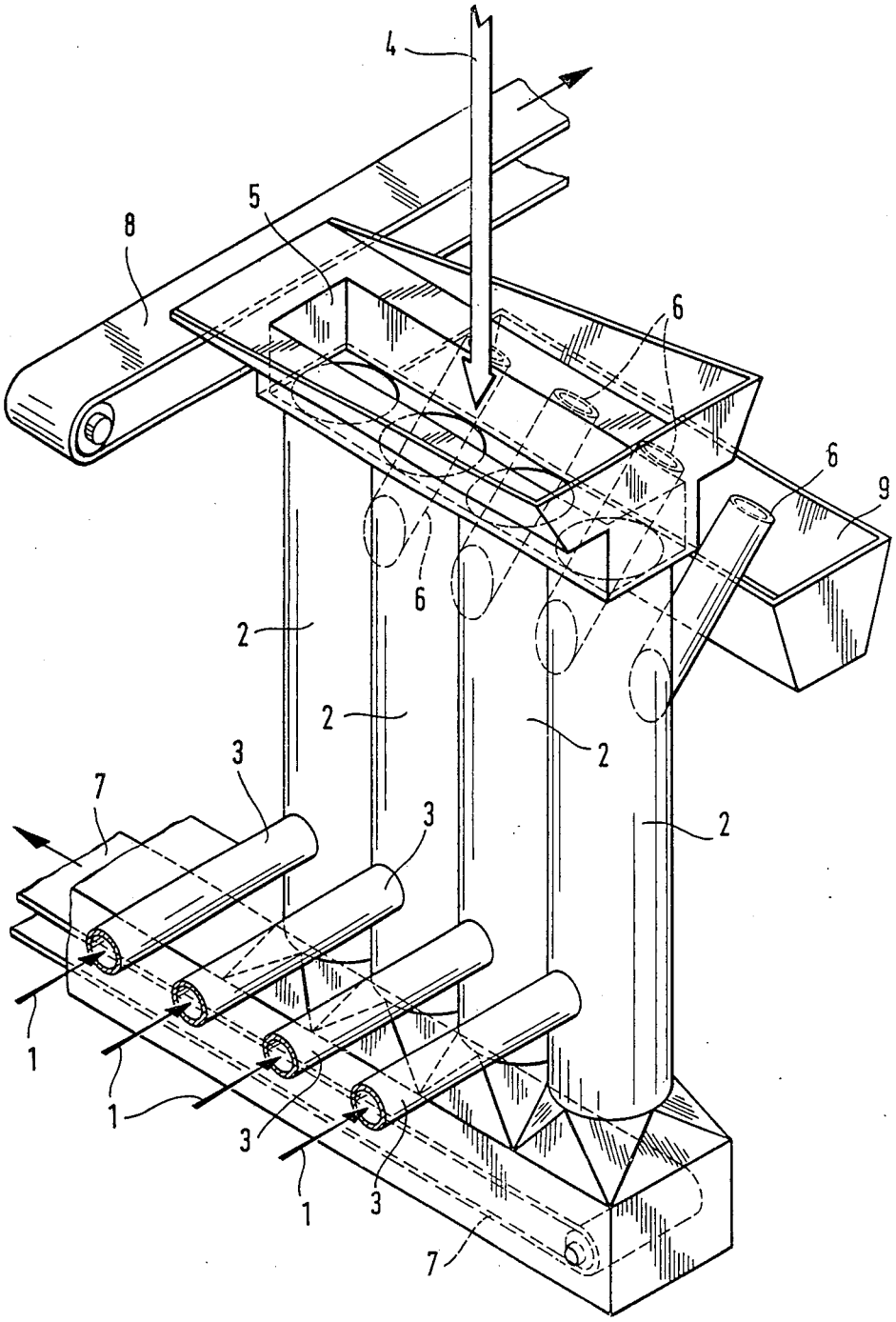
4
5
8
6
6
9
6
2
2
2
2
3
7
3
1
1
3
1
3
7

APPARATUS FOR SEPARATING MATERIALS

This is a continuation of application Ser. No. 016,263, filed Feb. 19, 1987 and now abandoned.

BACKGROUND OF THE INVENTION

The present invention relates to an apparatus for separating materials by making use of the difference in specific gravities, so that the material to be separated flows against the current of the flowing medium.

In the prior art, the U.S. Pat. No. 2,708,517 introduces a classifier based on the difference in specific gravities, wherein the material to be classified is fed in at the top, and the water employed in the classifier is fed in at the bottom of the apparatus. By aid of the upwards flowing water, the material to be classified is divided into several fractions according to their ability to resist the flowing of the water. Thus the lightest ingredients remain on the water surface and are discharged along with the overflow, whereas the heaviest ingredients sink down onto the bottom of the apparatus. In addition to this, the apparatus gives a possibility to divide the material into a third, intermediate fraction. This is achieved by constructing the apparatus so that the bottom part has an essentially smaller diameter than the top part, and thus the cone surface formed in between causes a difference in the flow rate. The third fraction is discharged from the watersurrounded classification department by employing a discharge pipe. Owing to the several different-sized collecting chambers pertaining to the top, bottom and intermediate fractions, there is formed a plurality of such surfaces onto which the material under classification may accumulate, which from time to time reduces the classification efficiency.

In the apparatus introduced in the U.S. Pat. No. 2,854,136, a mixer is employed for separating samples with different specific gravities from the heaviest impurities contained in the said samples. Therefore there is made a mixture of sand and water, which mixture is then fed into the apparatus according to the U.S. Pat. No. 2,854,136. The impurities thus separated, in the top part of the apparatus, from the samples under treatment, are conducted, along with the sand-and-water mixture, through a perforated intermediate plate into the mixer chamber, wherein the ingredients are separated in accordance with the cyclone principle. In order to improve the separation output, more water is fed into the cyclone separation. Consequently, the apparatus of the U.S. Pat. No. 2,854,136 is very complex in structure and is only suited for separating certain types of materials from each other.

The DE publication of application No. 3 210 972 relates to a separating apparatus, wherein the material to be purified is set into a turbulent flow in successive, serially connected separating chambers. By aid of the turbulent flow the various ingredients with different specific gravities which are contained in the sludge can be separated. Because in the apparatus of the DE publication of application No. 3 210 972, the use of several serially connected chambers is necessary in order to achieve an advantageous separation output, the apparatus naturally takes up a lot of space and is expensive to run.

The purpose of the present invention is to eliminate some of the drawbacks of the prior art and to achieve a new and simpler separating apparatus, which is small in size and economical as for the running expenses, and wherein the separation is carried out on the basis of the difference in specific gravities, so that the material to be separated is fed in countercurrent with respect to the flowing medium employed in the separation process.

SUMMARY OF THE INVENTION

According to the invention, the flowing medium is conducted, at the bottom of the apparatus, into at least two flow pipes with essentially equal diameters. The material to be separated is fed into the top part of the apparatus of the invention, which top part is advantageously uniform and thus common for all of the flow pipes. When the flowing medium and the material under separation meet, the material is made to divide into at least three separate fractions by aid of changes in the flow rate of the flowing medium. The lightest ingredients among the fractions are discharged from the separator along with the overflow at the top part of the apparatus, whereas the heaviest ingredients are discharged through the bottom part of the apparatus. The intermediate ingredients are discharged through a side flow pipe formed in the flow pipes proper. In the side flow pipe, the flow rate of the flowing medium is maintained essentially equal to the flow rate prevailing in the flow pipe proper, just below the flow opening of the side flow pipe. Thus the intermediate ingredients are first made to sink in the flowing medium to the vicinity of the opening of the side flow pipe, and therethrough out of the treatment, because above the mouth of the side flow pipe the flow pipe proper is widened into the uniform top part common for all flow pipes, which causes the flow rate of the flowing medium to decrease substantially.

If, according to the invention, at least two flow pipes are used, the diameter of the flow pipe can be chosen to be essentially small, so that an essentially laminar flow is created, which is necessary in order to achieve a good separation output. Moreover, in a flow pipe with a small diameter, there is achieved a high flow rate, which allows for remarkable differences in the flow rates while the separate fractions are conveyed. Thus also the number of desired fractions is easily increased by connecting more side flow pipes at different heights to the flow pipe proper.

BRIEF DESCRIPTION OF THE DRAWINGS

In the following the invention is explained in more detail with reference to the appended drawing, which shows a preferred embodiment of the invention in an axonomic side-view illustration.

DETAILED DESCRIPTION

The flowing medium 1 is conducted into the essentially vertical flow pipes 2 via the pipes 3 connected in the vicinity of the bottom of the flow pipes 2. The material 4 to be separated is fed into the uniform top part 5 common to all flow pipes, and the lightest ingredients of the material are discharged therefrom as an overflow into further treatment by aid of the conveyor 8. The rest of the material under separation starts to sink in the flowing medium 1. While the material 4 is discharged from the uniform top part 5 common to all flow pipes and enters the flow pipes 2 proper, the flow rate of the flowing medium 1 increases with respect to the material to be separated. Now the remaining, lightest ingredients of the material 4 stop sinking owing to the suitably chosen flowing medium. Specially for the said ingredients, to the flow pipe 2 there is connected a side flow pipe 6 which has a smaller diameter and which forms an angle of 30°-60° with the flow pipe 2, advantageously an angle between 40° and 50°, and into which side flow pipe 6 the floating intermediate ingredients are conducted by maintaining the flow rate of the flowing medium within the side flow pipe equal to the flow rate prevailing in the flow pipe 2 proper when the flowing medium approaches the mouth opening of the side flow pipe. The recovered intermediate ingredients are conveyed into further treatment via the overflow tank 9.

The heaviest ingredients contained in the solid material 4 under separation, however, continue sinking and are discharged onto the conveyor 7 at the bottom end of the flow pipes 2, which conveyor takes the heaviest ingredients into further treatment. During the transfer onto the conveyor 7, the flowing medium 1 is separated from the solid material. The flowing medium 1 is also separated from the other recovered fractions before conducting them, 8, 9 into further treatment. The flowing medium 1 is recovered while it is being separated from the solid material, and it can be recirculated in the process.

The employed flowing medium can advantageously be for instance water, a mixture of ferrosilicon and water, or some other similar agent, depending on what kind of flowing circumstances are desired in the flow pipes with respect to the material under treatment. Furthermore, the number of the flow pipes can advantageously be varied according to the changing capacity. Thus the apparatus of the invention is suitable for use with a large number of different materials irrespective of the capacity demands.

I claim:

1. Apparatus for separating a solid material into fractions of different respective specific gravities, comprising a main flow pipe having two opposite ends, the main flow pipe being disposed substantially vertically when the apparatus is in use, means for introducing a fluid into the main flow pipe by way of its lower end in a manner such as to establish a laminar flow of fluid upwards through the main flow pipe, and a branch flow pipe having an inlet end and an outlet end, the branch flow pipe being connected at its inlet end to the main flow pipe intermediate the ends thereof and extending upwards towards its outlet end, which is above its inlet end, so that when solid material to be separated is applied to the upper end of the main flow pipe, the material is separated into at least a light fraction of which the specific gravity is such that it does not enter the main flow pipe against the flow of the fluid, a heavy fraction of which the specific gravity is such that it falls to the lower end of the main flow pipe against the flow of the fluid, and an intermediate fraction of which the specific gravity is such that it falls against the flow of the fluid to the level of the inlet end of the branch flow pipe and is conducted from the main flow pipe by way of the branch flow pipe.

2. Apparatus according to claim 1, wherein the branch flow pipe is wholly outside the main flow pipe.

3. Apparatus according to claim 1, wherein the main flow pipe is bounded by an exterior wall and the inlet end of the branch flow pipe forms an opening in the exterior wall.

4. Apparatus for separating a solid material into fractions of different respective specific gravities, comprising at least first and second main flow pipes each having two opposite ends, the main flow pipes being disposed substantially vertically when the apparatus is in use, means for introducing a fluid into the main flow pipes by way of the lower ends thereof in a manner such as to establish a laminar flow of fluid upwards through each of the main flow pipes, and first and second branch flow pipes each having an inlet end and an outlet end, the branch flow pipes being connected at their respective inlet ends to the first and second main flow pipes intermediate the ends thereof and extending upwards towards their respective outlet ends, which are above their inlet ends, so that when solid material to be separated is applied to the upper end of one of the main flow pipes, the material is separated into at least a light fraction of which the specific gravity is such that it does not enter said one main flow pipe against the flow of the fluid, a heavy fraction of which the specific gravity is such that it falls to the lower end of said one main flow pipe against the flow of the fluid, and an intermediate fraction of which the specific gravity is such that it falls against the flow of the fluid to the level of the inlet end of the branch flow pipe of said one main pipe and is conducted from said one main flow pipe by way of its branch flow pipe.

5. Apparatus according to claim 4, wherein the main flow pipes are interconnected at the top and form a common, uniform space for the feeding and separation of the solid material.

6. Apparatus according to claim 4, wherein the branch flow pipes of the two main flow pipes are substantially equal in diameter.

7. Apparatus according to claim 4, wherein the diameter of each main flow pipe is greater than the diameter of its branch flow pipe.

8. Apparatus according to claim 4, wherein the main flow pipes are substantially equal in diameter.

9. Apparatus according to claim 4 wherein the first and second branch flow pipes are each wholly outside the first and second main flow pipes.

10. Apparatus according to claim 4, wherein each of the main flow pipes is bounded by an exterior wall, and the inlet ends of the first and second branch flow pipes respectively form openings in the exterior walls of the first and second main flow pipes respectively.

11. A method for separating a solid material into fractions of different respective specific gravities, comprising:

providing a main flow pipe having two opposite ends and a branch flow pipe having first and second opposite ends, the first end of the branch flow pipe being connected to the main flow pipe intermediate the ends thereof, and the branch flow pipe extending at an acute angle to the main flow pipe, disposing the main flow pipe substantially vertically with one end of the main flow pipe higher than the other end thereof and with the branch flow pipe directed upwardly away from the main flow pipe so that the second end of the branch flow pipe is above the first end thereof, establishing a laminar flow of fluid upwardly through the main flow pipe, and applying solid material to be separated to said one end of the main flow pipe, whereby the material is separated into at least a light fraction of which the specific gravity is such that it does not enter the main flow pipe against the flow of the fluid, a heavy fraction of which the specific gravity is such that it falls to said other end of the main flow pipe against the flow of the fluid, and an intermediate fraction of which the specific gravity is such that it falls against the flow of the fluid to the level of the first end of the branch flow pipe and is conducted from the main flow pipe by way of the branch flow pipe.

12. A method according to claim 11, comprising providing a second main flow pipe having two opposite ends and a second branch pipe connected to the second main flow pipe intermediate the ends thereof, disposing the second main flow pipe substantially vertically with one end higher than the other end thereof and with the second branch pipe directed upwardly away from the second main flow pipe, establishing a laminar flow of fluid upwardly through the second main flow pipe, and applying solid material of substantially the same composition to said one end of said second main flow pipe as to said one end of the first-mentioned main flow pipe.

13. A method for separating a solid material into fractions of different respective specific gravities, comprising:

providing a main flow pipe having two opposite ends and a branch flow pipe having first and second opposite ends and disposed wholly outside the main flow pipe, the first end of the branch flow pipe being connected to the main flow pipe intermediate the ends thereof, and the branch flow pipe extending at an acute angle to the main flow pipe, disposing the main flow pipe substantially vertically with one end of the main flow pipe higher than the other end thereof and with the branch flow pipe directed upwardly away from the main flow pipe so that the second end of the branch flow pipe is above the first end thereof, establishing a laminar flow of fluid upwardly through the main flow pipe, and applying solid material to be separated to said one end of the main flow pipe, wherein the material is separated into at least a light fraction of which the specific gravity is such that it does not enter the main flow pipe against the flow of the fluid, a heavy fraction of which the specific gravity is such that that it falls to the other end of the main flow pipe against the flow of the fluid, and intermediate fraction of which the specific gravity is such that it falls against the flow of the fluid to the level of the first end of the branch flow pipe and is conducted out of the main flow pipe by way of the branch flow pipe.

* * * * *